US009849329B2

(12) United States Patent
Huang

(10) Patent No.: US 9,849,329 B2
(45) Date of Patent: Dec. 26, 2017

(54) EXERCISE DEVICE

(71) Applicant: Dyaco International Inc., Taipei (TW)

(72) Inventor: Hsuan-Fu Huang, Taipei (TW)

(73) Assignee: Dyaco International Inc., Taipei (TW)

( * ) Notice: Subject to any disclaimer, the term of this patent is extended or adjusted under 35 U.S.C. 154(b) by 109 days.

(21) Appl. No.: 15/016,177

(22) Filed: Feb. 4, 2016

(65) Prior Publication Data

US 2017/0209734 A1 Jul. 27, 2017

(30) Foreign Application Priority Data

Jan. 22, 2016 (TW) ..... 105101977 A

(51) Int. Cl.

| | |
|---|---|
| ***A63B 23/04*** | (2006.01) |
| ***A63B 22/00*** | (2006.01) |
| ***A63B 24/00*** | (2006.01) |
| ***A63B 22/02*** | (2006.01) |

(52) U.S. Cl.

CPC ..... *A63B 22/0017* (2015.10); *A63B 22/0023* (2013.01); *A63B 22/025* (2015.10); *A63B 22/0285* (2013.01); *A63B 24/0087* (2013.01); *A63B 2022/002* (2013.01); *A63B 2024/009* (2013.01); *A63B 2024/0093* (2013.01); *A63B 2220/05* (2013.01)

(58) Field of Classification Search

USPC ..... 482/1–148

See application file for complete search history.

(56) References Cited

U.S. PATENT DOCUMENTS

| | | | | |
|---|---|---|---|---|
| 6,837,830 | B2 * | 1/2005 | Eldridge | A63B 21/157 482/54 |
| 7,231,834 | B2 * | 6/2007 | Kurono | A61B 5/1038 348/61 |
| 7,914,420 | B2 * | 3/2011 | Daly | A63B 22/0235 119/700 |
| 8,605,990 | B2 * | 12/2013 | Izumi | A63B 6/00 345/419 |
| 8,979,710 | B2 * | 3/2015 | McCready | A63B 71/0622 482/8 |
| 9,470,705 | B2 * | 10/2016 | Statham | A43B 7/1455 |
| 2002/0130951 | A1 * | 9/2002 | Kurono | G01C 22/006 348/61 |
| 2009/0156363 | A1 * | 6/2009 | Guidi | A63B 71/0619 482/4 |

(Continued)

FOREIGN PATENT DOCUMENTS

| | | |
|---|---|---|
| CN | 103623540 A | 3/2014 |
| TW | M519534 U | 4/2016 |
| TW | M525765 U | 7/2016 |

OTHER PUBLICATIONS

Office Action Dated Dec. 8, 2016 in corresponding Taiwan Patent Application No. TW105101977.

*Primary Examiner* — Stephen Crow

(74) *Attorney, Agent, or Firm* — Donald E. Stout; Stout, Uxa & Buyan, LLP

(57) ABSTRACT

An exercise device includes one or more image-capturing units, two identity backgrounds, and a processing unit. Each image-capturing unit captures images of one corresponded identity background shaded by a user, and the processing unit analyzes the captured images in real time, so as to automatically control the exercise device.

18 Claims, 10 Drawing Sheets

(56) References Cited

U.S. PATENT DOCUMENTS

| | | | | |
|---|---|---|---|---|
| 2010/0152629 | A1* | 6/2010 | Haas, Jr. | A61B 5/1038 601/34 |
| 2015/0080181 | A1* | 3/2015 | Skulman | A63B 24/0075 482/3 |
| 2015/0140534 | A1* | 5/2015 | Brunner | A63B 22/025 434/255 |
| 2016/0213976 | A1* | 7/2016 | So | A63B 71/0622 |

* cited by examiner

EXERCISE DEVICE

CROSS-REFERENCE TO RELATED APPLICATIONS

The entire contents of Taiwan Patent Application No. 105101977, filed on Jan. 22, 2016, from which this application claims priority, are expressly incorporated herein by reference.

BACKGROUND OF THE INVENTION

1. Field of the Invention

The present invention relates to exercise devices, and more particularly relates to treadmills providing automatic controls.

2. Description of Related Art

Nowadays, people tend to lack adequate exercise due, for example, to busy lifestyles. To the extent running has become popular as a simple and effective means for squeezing physical activity into a tight schedule, it is not always practicable. When the weather is bad or during particular times such as at night, running on a treadmill can be more convenient as compared to being outside.

Prior treadmills, such as disclosed in Taiwan Patents I468200, have sought to rehabilitate heath by arranging sensors at a left side and a right side of a belt, and when a user runs on the belt, the sensors are used for detecting a pace start point and a pace stop point of the user, therefore generating an activation signal and a stop signal of the belt, so as to control the belt by the stop signal and the activation signal. The process is repeated and repeated again so that the rehabilitation effect can be achieved.

To obtain the positions of feet of the user, many pairs of infrared sensors are needed to be placed at the left side and the right side of the belt. However, the quantity of the sensors must be sufficient if the positions of the user's feet are precisely needed. It is not easy to arrange too many sensors at the two sides of the belt, and the infrared sensors are expensive and may be damaged by kicking of the user or by the vibration due to the running.

SUMMARY OF THE INVENTION

In one general aspect, the present invention relates to exercise devices featuring automatic controls and easy manners of use.

In an embodiment of the present invention, an exercise device is provided with a belt, two identity backgrounds, at least one image-capturing unit, and a processing unit. The two identity backgrounds are respectively arranged at a left side and a right side of the belt. The at least one image-capturing unit faces the belt and the two identity backgrounds for capturing images of two identity backgrounds shaded by a user. The processing unit connects with the at least one image-capturing unit for analyzing the captured images so as to obtain a variation of the user's position and thus control the exercise device according to the variation of the user's position.

In an embodiment, the processing unit obtains the variation of the user's position by analyzing a variation of grayscale of the captured images.

In an embodiment, each of the two identity backgrounds comprises one or more light sources.

In an embodiment, each of the two identity backgrounds comprises a reflector.

In an embodiment, the exercise device further comprises two light sources, wherein each of the two light sources corresponds one of the two reflectors and emits a light to the corresponded reflector.

In an embodiment, the two identity backgrounds are respectively arranged at a left side edge and a right side edge of the belt.

In an embodiment, the exercise device further comprises two decorating bars respectively arranged at a left side and a right side of the belt, and wherein the two identity backgrounds are respectively arranged at a side of one decorating bar.

In an embodiment, the exercise device further comprises a left post and right post respectively arranged near a left front corner and a right front corner of the belt, and wherein the number of the at least one image-capturing unit is two, and the two image-capturing units are respectively arranged at the left post and the right post.

In an embodiment, if two shaded area are observed in an image captured by the at least one image-capturing unit, the shaded area closer to the front of the belt will be analyzed and the shaded area closer to the rear of the belt will be ignored.

In an embodiment, the number of the at least one image-capturing unit is two, and the two image-capturing units, and the image-capturing units are arranged in a middle portion in front of the belt for respectively capturing images of the opposite corresponded identity background.

In an embodiment, the number of the at least one image-capturing unit is one, and the image-capturing unit is arranged on a middle portion of a housing in front of the belt for simultaneously capturing images of the two identity backgrounds.

In an embodiment, the belt comprises a speeding zone, a normal zone, and a slowing zone, and when more than a predetermined percentage of the user's paces is within the speeding zone during a predetermined period of time, then the processing unit increases the rotational speed of the belt; when more than the predetermined percentage of the user's paces is within the normal zone during a predetermined period of time, then the rotational speed of the belt is not varied; and when more than the predetermined percentage of the user's paces is within the slowing zone during a predetermined period of time, then the processing unit decreases the rotational speed of the belt.

In an embodiment, the belt comprises an ascending zone and a descending zone, and when more than a predetermined percentage of the user's paces is within the ascending zone during a predetermined period of time, then the processing unit increases an incline angle of the belt; when more than the predetermined percentage of the user's paces is within the descending zone during the predetermined period of time, then the processing unit decreases the incline angle of the belt.

In another embodiment of the present invention, an exercise device is provided with a belt, an identity background, at least two image-capturing units, and a processing unit. The identity background is arranged on a middle portion of the belt. The at least two image-capturing units face the belt and the identity background for capturing images of the identity background shaded by the user. The processing unit analyzes the captured images so as to obtain a variation of the user's position and thus control the exercise device according to the variation of the user's position.

DETAILED DESCRIPTION OF THE PREFERRED EMBODIMENT

Reference will now be made in detail to those specific embodiments of the invention. Examples of these embodiments are illustrated in accompanying drawings. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components. Wherever possible, the same or similar reference numbers are used in drawings and the description to refer to the same or like parts.

The present invention provides exercise devices with novel detecting configuration and method. According to a preferred embodiment of this invention, an exercise device is provided with one or more image-capturing units. Each image-capturing unit continually captures images of an identity background shaded by a user. A processing unit is used for analyzing the captured images, so as to obtain the variation of the user's pace, and thus the processing unit controls the exercise device by the variation of the user's pace, and one or more the user's parameters can be also obtained.

Figure 1:
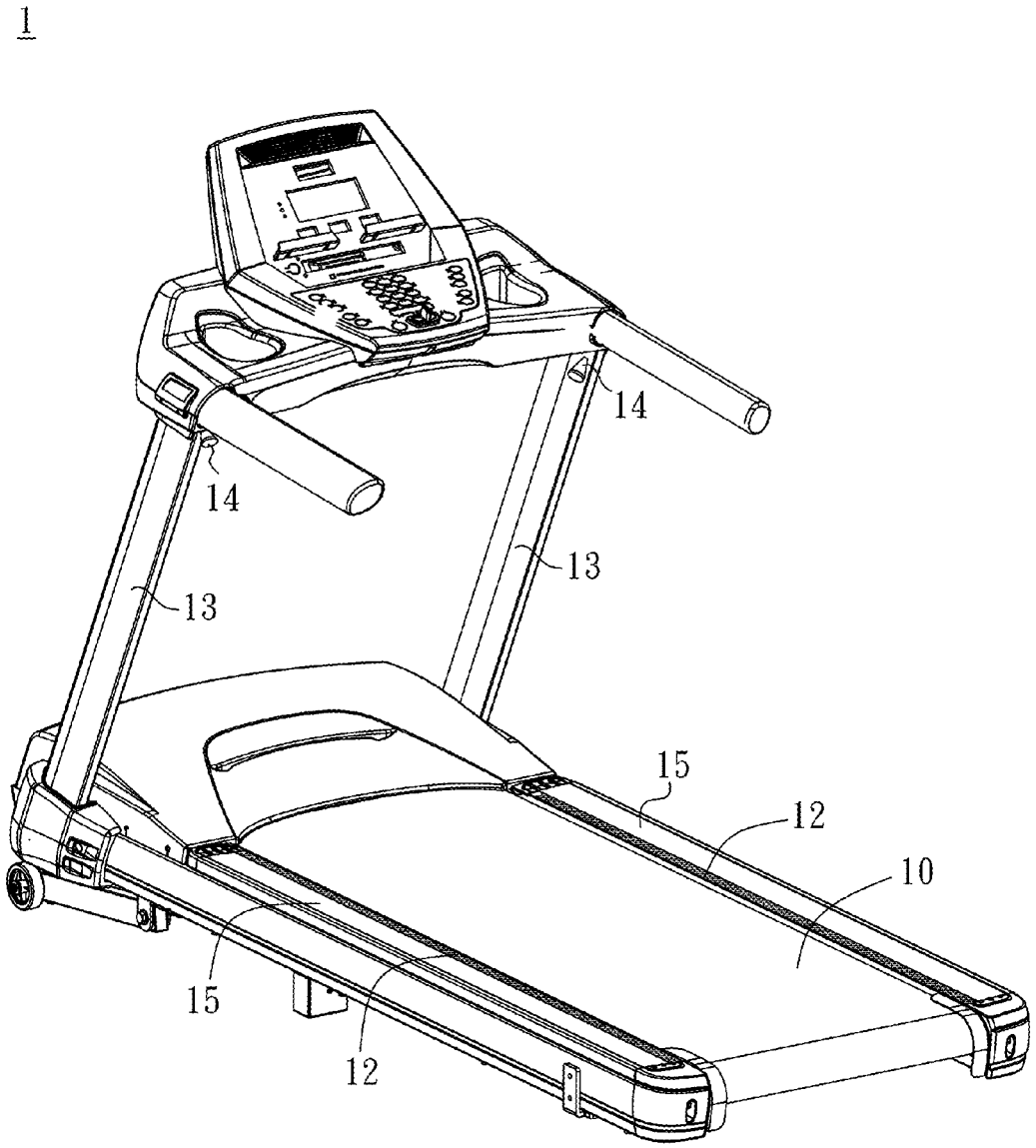
FIG. 1 is perspective view showing an exercise device according to a preferred embodiment of the present invention.
Figure 2:
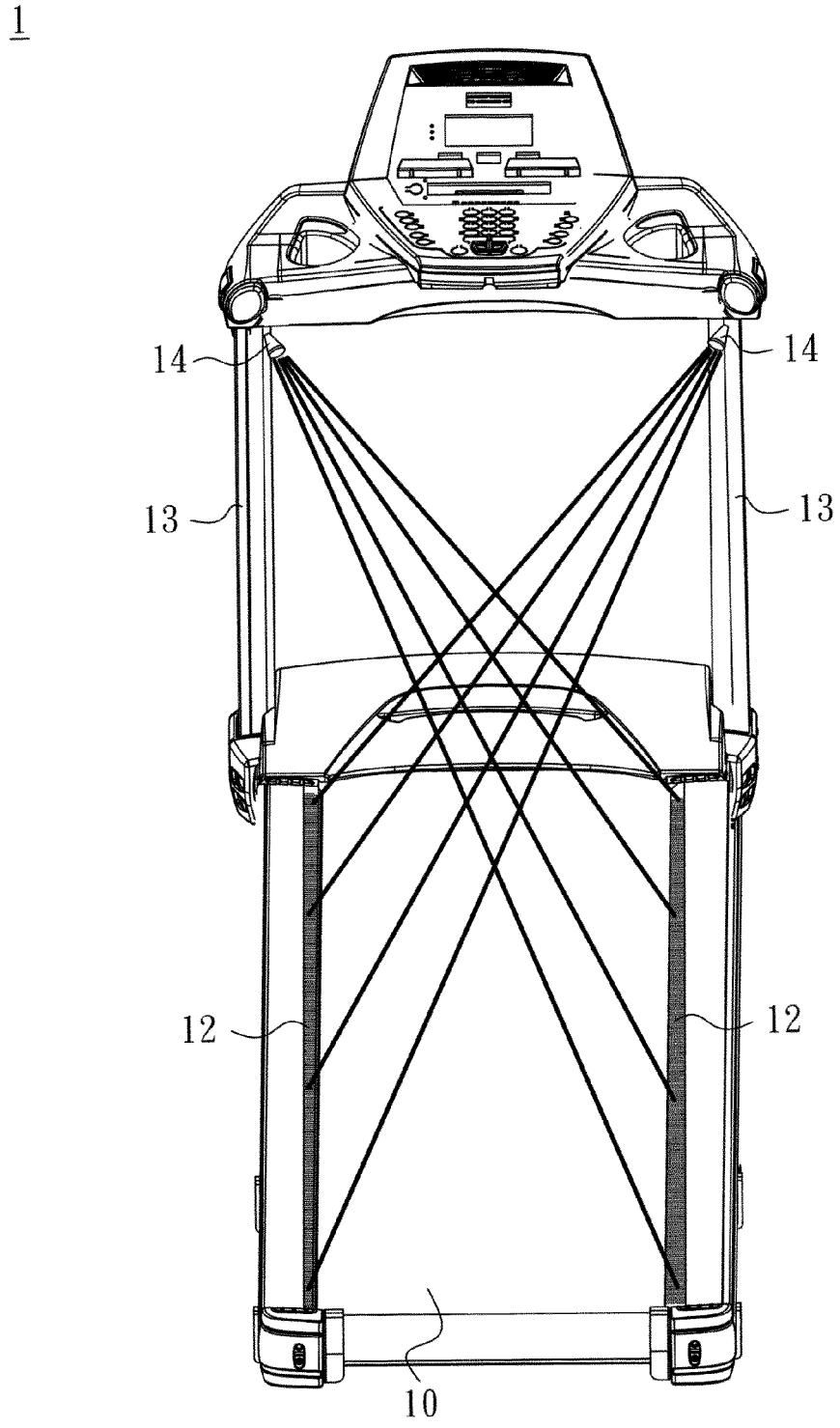
FIG. 2 is perspective view showing an exercise device according to a preferred embodiment of the present invention.

FIGS. 1 and 2 are perspective views showing an exercise device 1 according to a preferred embodiment of the present invention. In this preferred embodiment, the exercise device 1 is a treadmill 1.

Referring to FIGS. 1 and 2, the treadmill 1 comprises a belt 10 on which a user walks or runs in place. Two identity backgrounds 12 are arranged at suitable positions of the exercise device 1. For example, the two identity backgrounds 12 are arranged on the belt 10 or arranged at a left side and a right side of the belt 10, respectively. In this preferred embodiment, two decorating bars 15 are respectively arranged at a left side and a right side of the belt 10, and the two identity backgrounds 12 are respectively arranged, for example, at a side of one decorating bar 15 facing the belt 10. In another embodiment of this invention, the two identity backgrounds are respectively arranged at a left side edge and a right side edge of the belt 12. In addition, two image-capturing units 14 are arranged at proper positions for facing the identity backgrounds 12. For example, the two identity backgrounds 12 are arranged at a left post 13 and a right post 13, respectively. Each image-capturing unit 14 can receive light beam from one corresponded identity background 14 opposite to the image-capturing unit 14, and captures images of the corresponded identity background 14.

In this preferred embodiment, each image-capturing unit 14 comprises a Complementary Metal-Oxide Semiconductor (CMOS). In another embodiment of the present invention, each image-capturing unit 14 comprises a Charge-coupled Device (CCD).

In this preferred embodiment, each identity background 12 is a reflector 12, which can reflect the light (such as sunlight or artificial light) to the opposite corresponded image-capturing unit 14.

In another embodiment of this invention, each identity background 12 may comprise one or more light sources. For example, each identity background 12 may comprise one or more light-emitting diodes.

Figure 3:
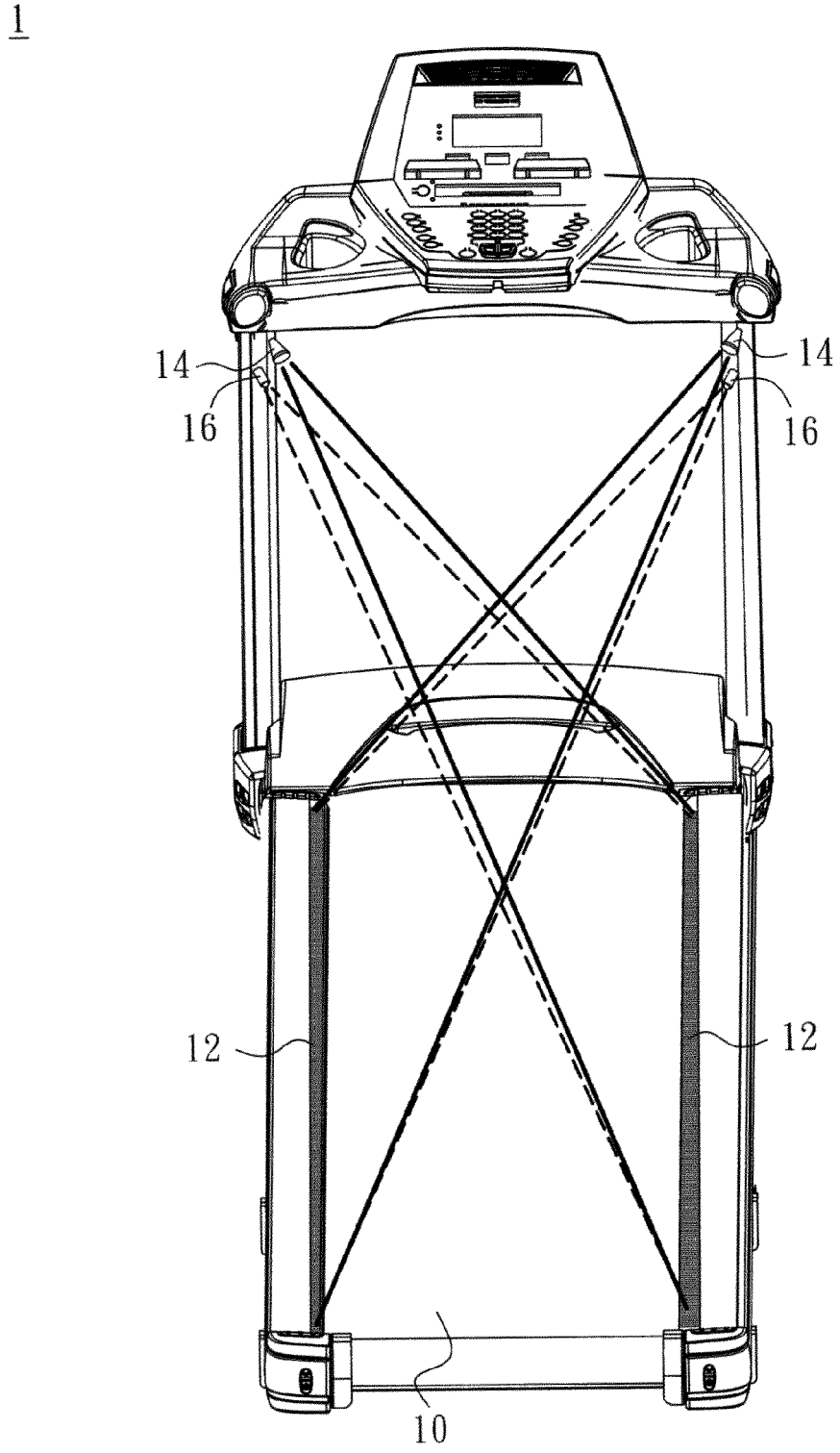
FIG. 3 is perspective view showing an exercise device according to another embodiment of the present invention.

FIG. 3 shows another exercise device 1 according to another embodiment of the present invention. Referring to FIG. 3, the exercise device 1 may further comprise at least two light sources 16 respectively arranged at a position near to one image-capturing unit 14. Each light source 16 can emit light to the opposite corresponded reflector 12, which then reflects the light to the opposite corresponded image-capturing unit 14. In an embodiment of the present invention, the two light sources 16 are activated manually. In another embodiment of the present invention, the exercise device 1 further comprises a luminosity sensor (not shown) for detecting the luminosity of the environment. If the luminosity of the environment is insufficient, then the two light sources 16 are automatically activated. Notice should be made that the two light sources 16 can be arranged at other positions of the exercise device 1.

Referring to FIGS. 2 and 3, each image-capturing unit 14 can continually capture images of the identity background 12 shaded by the user. For example, each image-capturing unit 14 can capture 200 images per second. In this preferred embodiment, the exercise device 1 comprises a processing unit (not shown) for analyzing the captured images.

The captured images are composed of pixels. The positions of the identity background 12 and the image-capturing unit are fixed. The legs and/or feet of the user may block the light from the identity background 12. The images shaded by the user will result in a variation, such as variation of grayscale of the captured images, and the variation of the captured images is analyzed by the processing unit, so as to obtain the variation of the user's paces.

In an embodiment of the present invention, the belt 10 is divided into several zones, and the processing unit analyzes the captured images, so as to determine the user's pace is within which zone.

Figure 4:
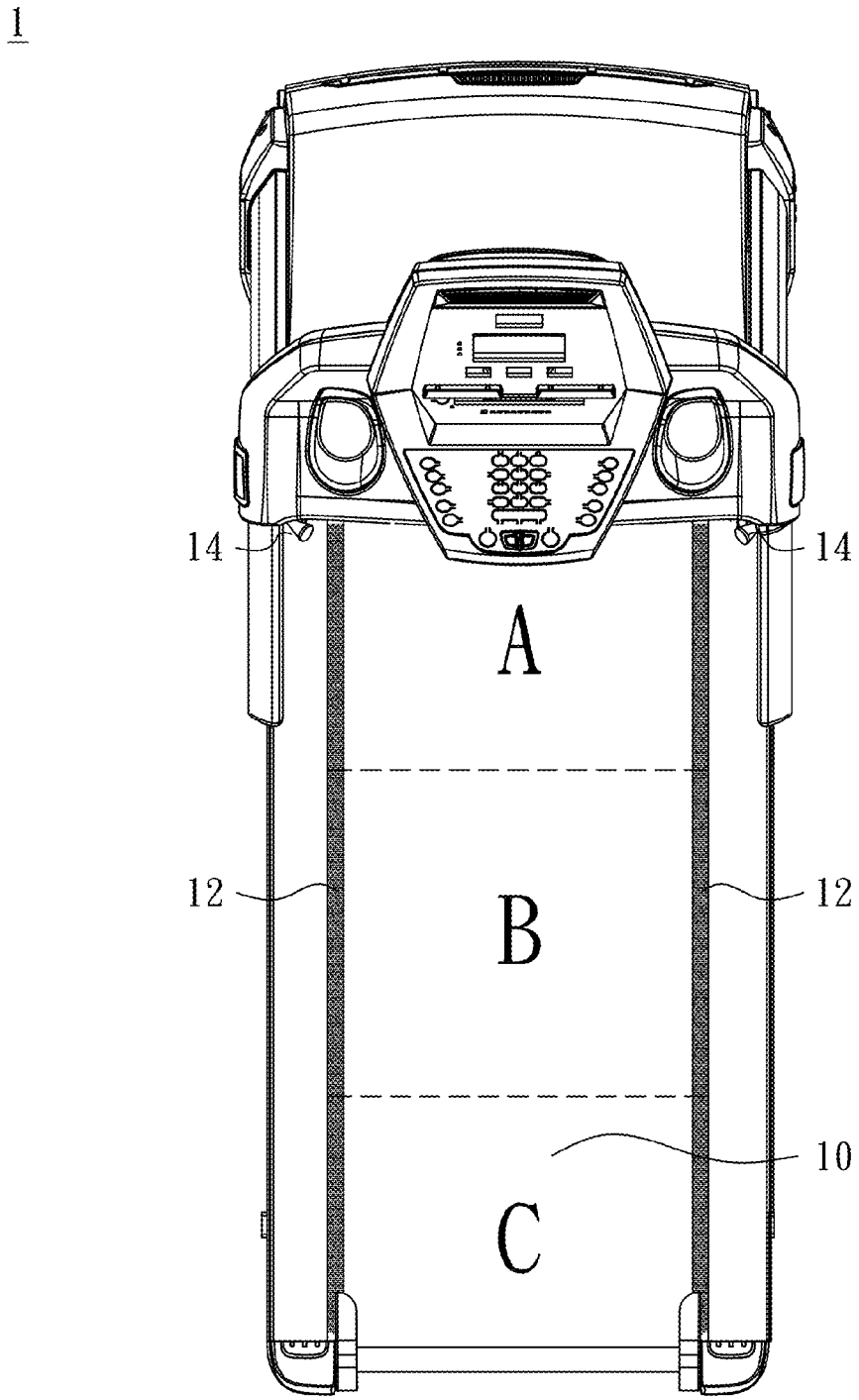
FIG. 4 is perspective view showing an exercise device according to a preferred embodiment of the present invention.

FIG. 4 illustrates an exercise device according to the preferred embodiment of the present invention. In this preferred embodiment, the belt 10 may comprise, but is not limited to, a speeding zone A, a normal zone B, and a slowing zone C, and the processing unit analyzes the images captured during a predetermined period of time, e.g., during two seconds, so as to judge that the user's pace is within the speeding zone A, normal zone B, or slowing zone C. And the processing unit controls the exercise device 1 according to the judgment.

Figure 5:
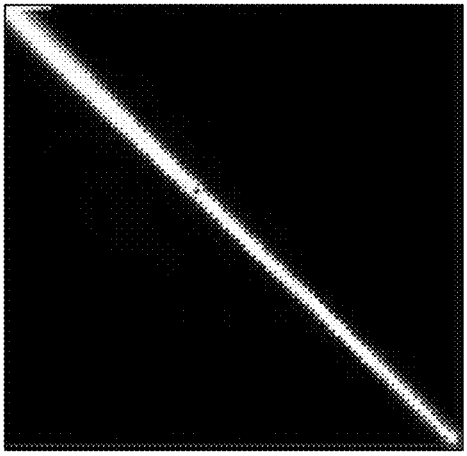
FIGS. 5, 6, and 7 are images captured by an image-capturing unit of the exercise device according to the preferred embodiment of the present invention.
Figure 6:
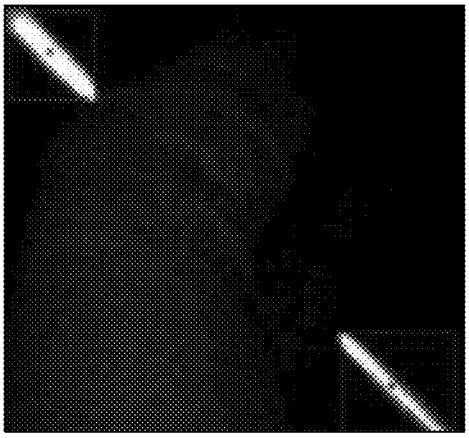
Figure 7:
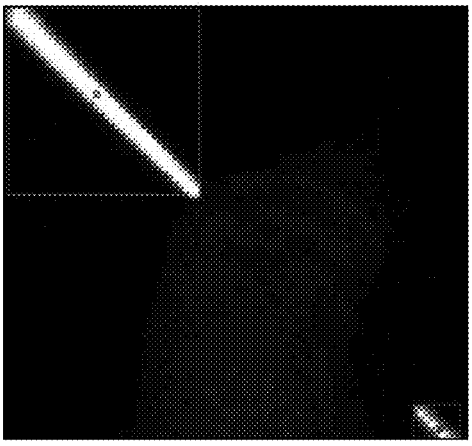

FIGS. 5, 6, and 7 are examples showing images captured by one image-capturing unit 14 of the exercise device 1. A complete identity background 12 is shown in FIG. 5 because there is no user running on the belt 10 and therefore the identity background 12 is not shaded by the user. FIG. 6 shows an image that the identity background 12 is shaded by the user when one foot of the user steps on the normal zone B of the belt 10. A change of a property, e.g., the grayscales of the image within the shaded area corresponding to the normal zone B, is observed. FIG. 7 shows an image that the identity background 12 is shaded by the user when one foot of the user steps one the slowing zone C of the belt 10. A change of a property, e.g., the grayscales of the image within the shaded area corresponding to the slowing zone C, is observed.

Accordingly, the processing unit can judge that more than a predetermined percentage (e.g., 50%) of the user's paces is within the speeding zone A, normal zone B, or slowing zone C, during a predetermined period of time (e.g., 2 seconds) by analyzing the property (e.g., grayscale) of the captured images. In addition, if one identity background 12 is shaded by the left foot and the right foot, two shading areas are observed in the captured image. In this situation, the processing unit preferably chooses the shading area that is nearer to the front of the belt 10, and ignores the other shading area. In another embodiment of the present invention, if two shading areas are observed in one captured image, the processing unit preferably chooses the shading area that is nearer to the rear of the belt 10 and ignores the other shading area.

Referring to FIG. 4, the processing unit can automatically control the exercise device 1 according the analyzing result. For example, when more than a predetermined percentage of the user's paces is within the speeding zone A during a predetermined period of time, then the processing unit increases the rotational speed of the belt 10. When more than the predetermined percentage of the user's paces is within the normal zone B during a predetermined period of time, then the rotational speed of the belt 10 is not varied. When more than the predetermined percentage of the user's paces is within the slowing zone C during a predetermined period of time, then the processing unit decreases the rotational speed of the belt 10. In another embodiment of this invention, the belt 10 may comprise more than three zones.

Referring to FIG. 4, the range of the speeding zone A, the normal zone B, and the slowing zone C can be predetermined by the exercise device 1 or inputted by the user. For example, if a length of an area of the belt 10 allowing the user for running or walking is 120 cm, it can be predetermined that the lengths of the speeding zone A, the normal zone B, and the slowing zone C are 30 cm, 50 cm, and 40 cm, respectively. Or, the user may input and thus determine the lengths of the speeding zone A, the normal zone B, and the slowing zone C, e.g., 35 cm, 50 cm, and 35 cm, respectively.

Figure 8:
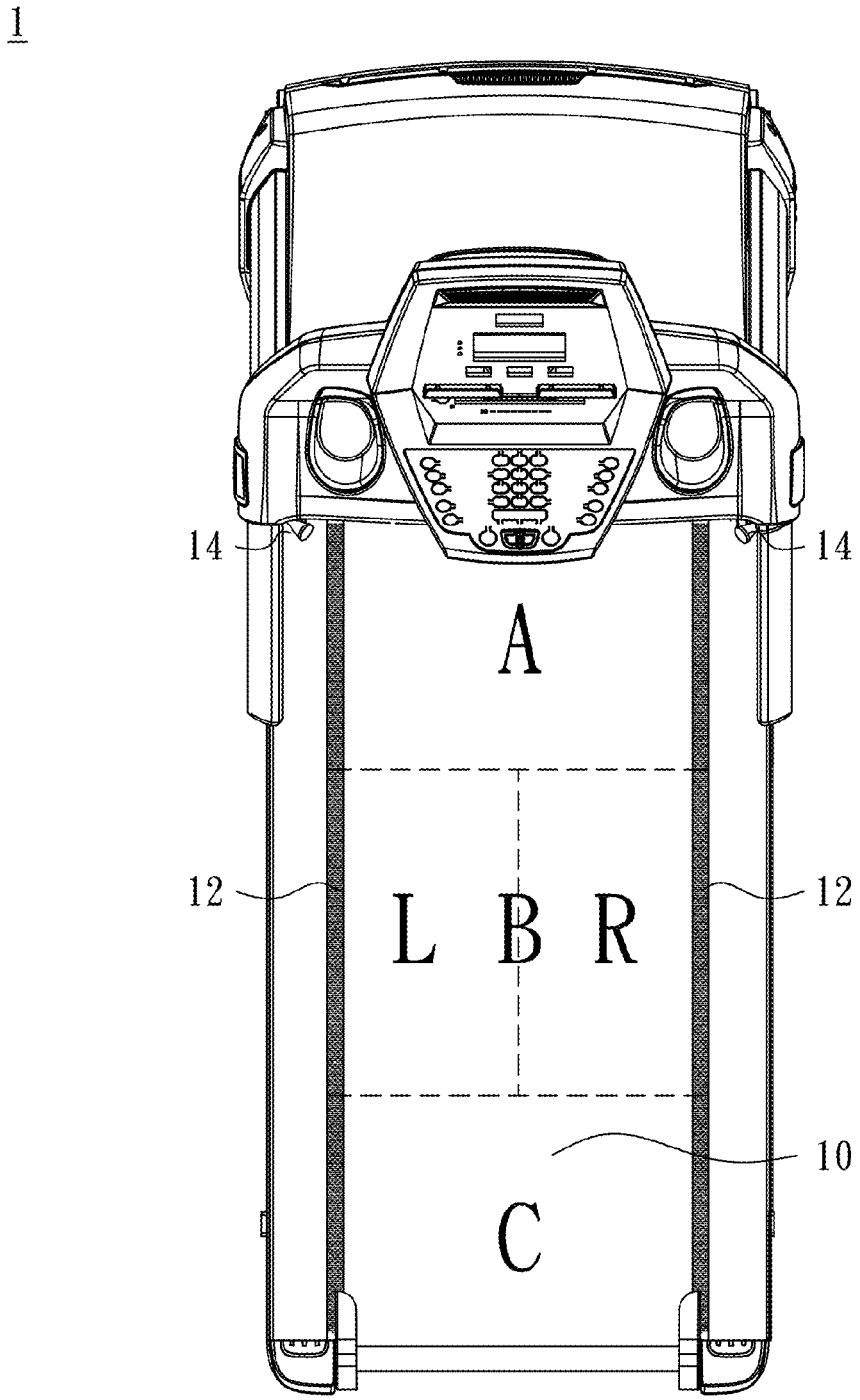
FIG. 8 is perspective view showing an exercise device according to a preferred embodiment of the present invention.

FIG. 8 shows an exercise device 1 according to another embodiment of the present invention. Referring to FIG. 8, the exercise device further comprises a ramp device (not shown) for adjusting the inclined angle of the belt 10, i.e., the angle between the belt 10 and the ground. In addition, the belt 10 comprises an ascending zone R and a descending zone L, as shown in FIG. 8. When more than a predetermined percentage (e.g., 50%) of the user's paces is within the ascending zone R during a predetermined period of time, then the processing unit increases the incline angle of the belt 10. When more than the predetermined percentage (e.g., 50%) of the user's paces is within the descending zone L during the predetermined period of time, then the processing unit decreases the incline angle of the belt 10. When the user moves to the ascending zone R or the descending zone L, the angle of the light reflected to the image-capturing unit 14 will be changed and thus the position of the shaded area will be changed, too. Therefore it can be judged that more than a predetermined percentage (e.g., 50%) of the user's paces is within the ascending zone R or the descending zone L.

Figure 9:
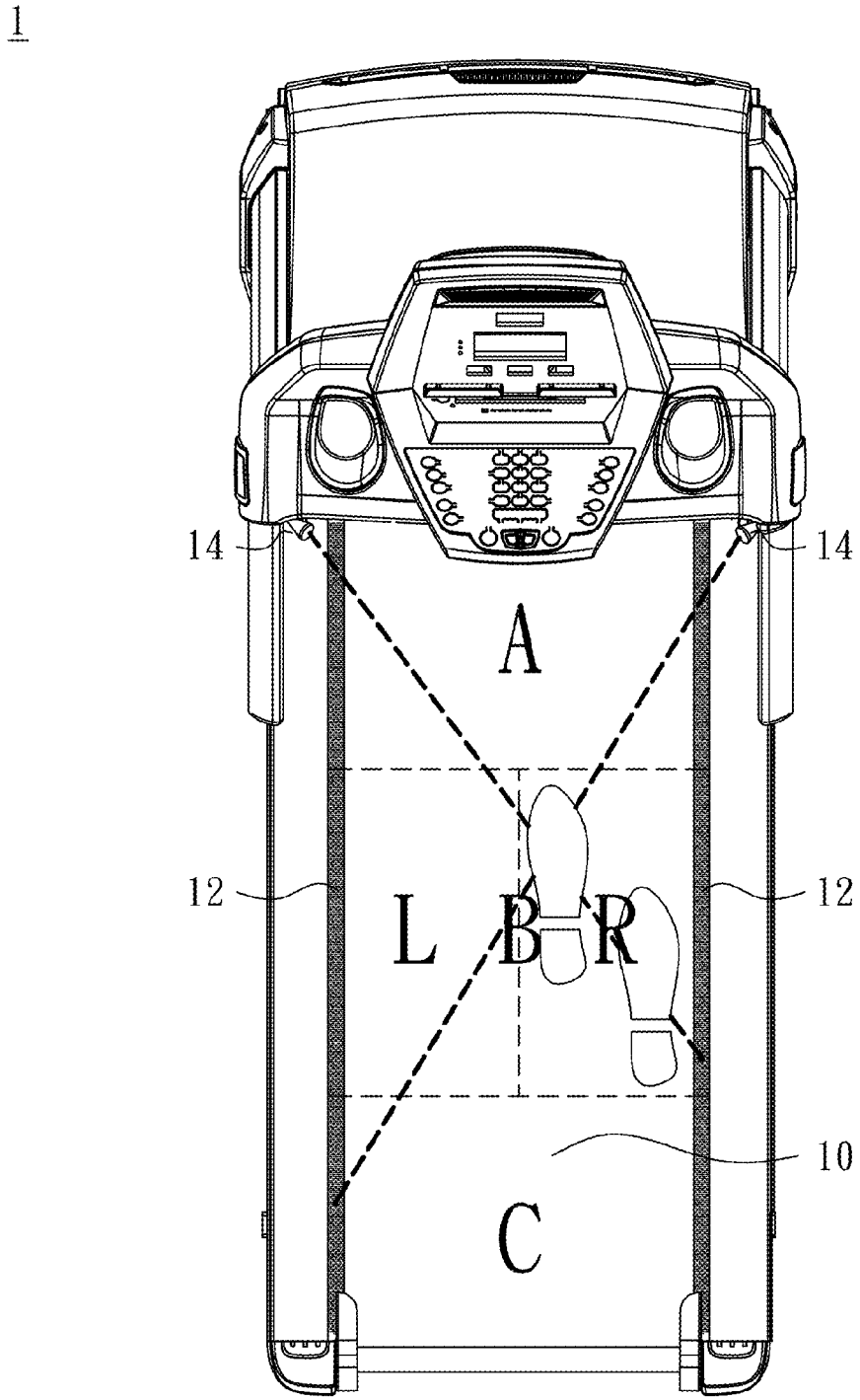
FIG. 9 is perspective view showing an operating example of the exercise device of FIG. 8.

FIG. 9 shows an operation example of the exercise device of FIG. 8. When the user moves to the ascending zone R, the right image-capturing unit 14 captures an image with a shaded area near the rear of the identity background 12 and the left image-capturing unit 14 captures an image with a shaded area near the middle of the identity background 12. Similarly, when the user moves to the descending zone L, the right image-capturing unit 14 captures an image with a shaded area near the middle of the identity background 12 and the left image-capturing unit 14 captures an image with a shaded area near the rear of the identity background 12. Accordingly, the position of one shaded area captured by one image-capturing unit 14 differs from the position of the other shaded area captured by the other image-capturing unit 14. When the distance between the two shaded areas is more than a percentage of the length of the identity background 12, e.g., more than 10%, or within a percentage between 5% and 40% of the length of the identity background 12 for a predetermined period of time, then the processing unit judges that the users moves to the ascending zone R or the descending zone L. In another embodiment of this invention, the position of the ascending zone R and the position of the descending zone L are exchanged.

Figure 10:
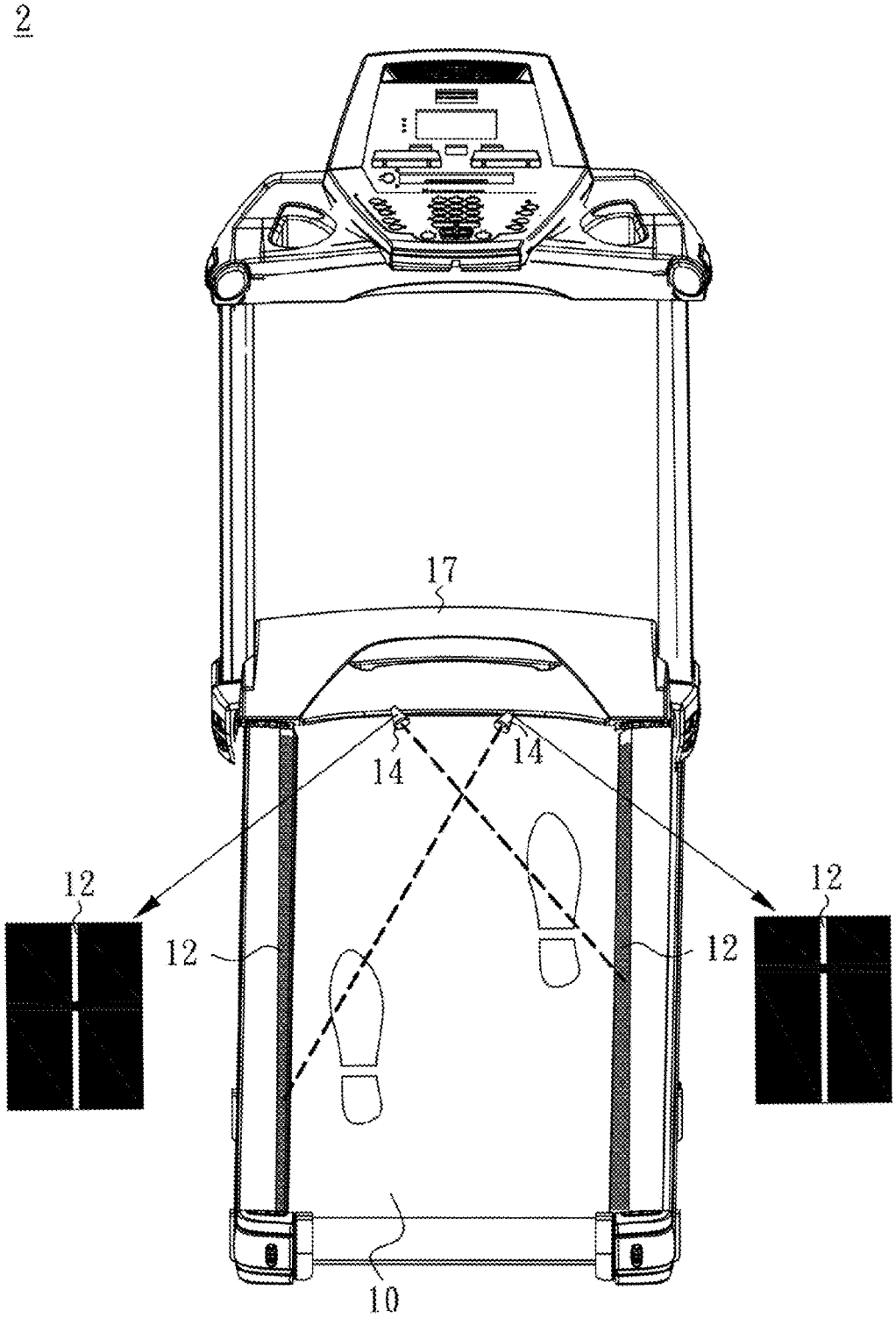
FIG. 10 shows an exercise device according to a second embodiment of the present invention.

FIG. 10 shows an exercise device 2 according to another embodiment of this invention. The exercise 2 differs from the exercise device 1 in the position of the image-capturing unit 14. Referring to FIG. 10, the two identity backgrounds 12, such as two reflectors 12 or two light sources 12, are respectively arranged at the left side and the right side of the belt 10. In addition, two image-capturing units 14 may be arranged in front of the belt 10, e.g., being arranged in the middle portion of a housing 17, for capturing images of the opposite corresponded identity background 12. FIG. 10 also illustrates two images captured by the two image-capturing units 14. According to the arrangement of this embodiment, each image captured by each image-capturing unit 14 will show only one shading area in the identity background 12.

Figure 11:
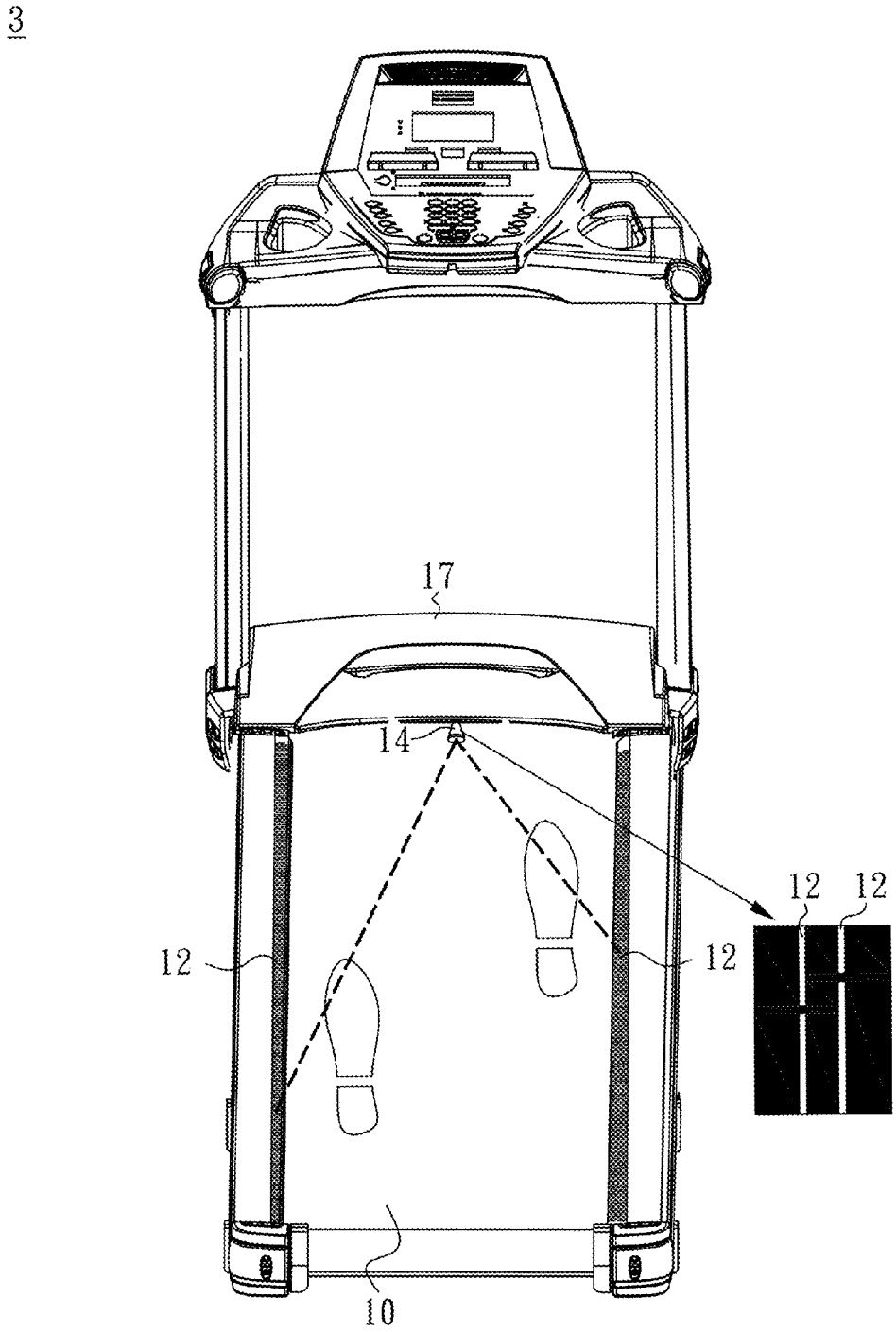
FIG. 11 shows an exercise device according to a third embodiment of the present invention.

FIG. 11 shows an exercise device 3 according to another embodiment of this invention. The exercise 3 differs from the exercise device 1 in the number of the image-capturing unit 14. Referring to FIG. 11, the two identity backgrounds 12, such as two reflectors 12 or two light sources 12, are respectively arranged at the left side and the right side of the belt 10. In addition, one image-capturing unit 14 may be arranged near the front of belt 10, e.g., being arranged on the middle portion of the housing 17. The image-capturing unit 14 can capture images of both identity backgrounds 12. FIG. 11 also illustrates one image captured by the image-capturing unit 14. According to the arrangement of this embodiment, each image captured by the image-capturing unit 14 will show only one shading area in the identity background 12.

Figure 12:
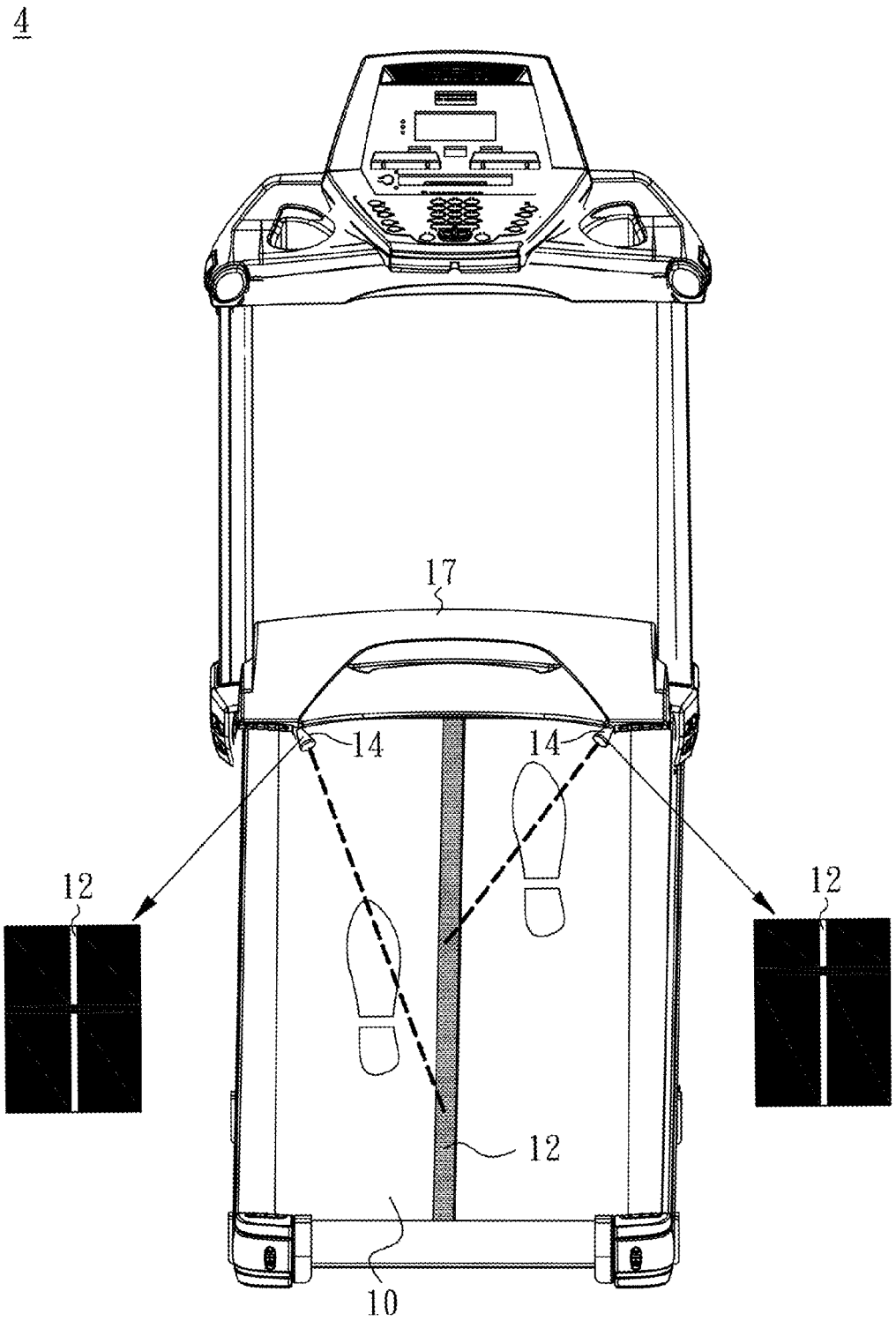
FIG. 12 shows an exercise device according to a fourth embodiment of the present invention.

FIG. 12 shows an exercise device 4 according to another embodiment of this invention. The exercise 4 differs from the exercise device 1 in the number of the identity background 12. Referring to FIG. 11, one identity background 12, such as reflector 12 or light source 12, is arranged at the middle portion of the belt 10. In addition, two image-capturing units 14 may be arranged on two corners of the housing 17, respectively, near the front of belt 10, for capturing images of the identity background 12. FIG. 12 also illustrates two images captured by the two image-capturing units 14. According to the arrangement of this embodiment, each image captured by each image-capturing unit 14 will show only one shading area in the identity background 12.

Compared with the prior art, the exercise devices provided by the present invention are more reliable and accurate for controls, and have varied functions and reduced cost.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. An exercise device, comprising:

a belt on which a user walks or runs in place;

two identity backgrounds being respectively arranged at a left side and a right side of the belt;

at least one image-capturing unit facing the belt and the two identity backgrounds for capturing images of two identity backgrounds shaded by the user; and a processing unit connected with the at least one image-capturing unit for analyzing the captured images so as to obtain a variation of the user's position and thus control the exercise device according to the variation of the user's position.

2. The exercise device as set forth in claim 1, wherein the processing unit obtains the variation of the user's position by analyzing a variation of grayscale of the captured images.

3. The exercise device as set forth in claim 1, wherein each of the two identity backgrounds comprises one or more light sources.

4. The exercise device as set forth in claim 1, wherein each of the two identity backgrounds comprises a reflector.

5. The exercise device as set forth in claim 4, further comprising two light sources, wherein each of the two light sources corresponds to one of the two reflectors and emits a light to the corresponded reflector.

6. The exercise device as set forth in claim 1, wherein the two identity backgrounds are respectively arranged at a left side edge and a right side edge of the belt.

7. The exercise device as set forth in claim 1, further comprising two decorating bars respectively arranged at a left side and a right side of the belt, and wherein the two identity backgrounds are respectively arranged at a side of one decorating bar.

8. The exercise device as set forth in claim 1, further comprising a left post and right post respectively arranged near a left front corner and a right front corner of the belt, and wherein there are two image-capturing units, and the two image-capturing units are respectively arranged at the left post and the right post.

9. The exercise device as set forth in claim 8, wherein if two shaded areas are observed in an image captured by the two image-capturing units, one of the two shaded areas close to the front of the belt will be analyzed and the other of the two shaded areas close to the rear of the belt will be ignored.

10. The exercise device as set forth in claim 1, wherein there are two image-capturing units, and the two image-capturing units are arranged in a middle portion in front of the belt for respectively capturing images of the opposite corresponded identity background.

11. The exercise device as set forth in claim 1, wherein the number of the at least one image-capturing unit is one, and the image-capturing unit is arranged on a middle portion of a housing in front of the belt for simultaneously capturing images of the two identity backgrounds.

12. The exercise device as set forth in claim 1, wherein the belt comprises a speeding zone, a normal zone, and a slowing zone, and when more than a predetermined percentage of the user's paces is within the speeding zone during a predetermined period of time, then the processing unit increases the rotational speed of the belt; when more than the predetermined percentage of the user's paces is within the normal zone during a predetermined period of time, then the rotational speed of the belt is not varied; and when more than the predetermined percentage of the user's paces is within the slowing zone during a predetermined period of time, then the processing unit decreases the rotational speed of the belt.

13. The exercise device as set forth in claim 1, wherein the belt comprises an ascending zone and a descending zone, and when more than a predetermined percentage of the user's paces is within the ascending zone during a predetermined period of time, then the processing unit increases an incline angle of the belt; when more than the predetermined percentage of the user's paces is within the descending zone during the predetermined period of time, then the processing unit decreases the incline angle of the belt.

14. An exercise device, comprising:

a belt on which a user walks or runs in place;

an identity background being arranged on a middle portion of the belt;

at least two image-capturing units facing the belt and the identity background for capturing images of the identity background shaded by the user; and a processing unit for analyzing the captured images so as to obtain a variation of the user's position and thus control the exercise device according to the variation of the user's position.

15. The exercise device as set forth in claim 14, wherein the processing unit obtains the variation of the user's position by analyzing a variation of grayscale of the captured images.

16. The exercise device as set forth in claim 14, wherein the identity background comprises one or more light sources.

17. The exercise device as set forth in claim 14, wherein the identity background comprises a reflector.

18. The exercise device as set forth in claim 17, further comprising at least one light source, and wherein the at least one light source emits a light to the reflector.

* * * * *